US006792923B2

(12) United States Patent
Kumagai et al.

(10) Patent No.: US 6,792,923 B2
(45) Date of Patent: Sep. 21, 2004

(54) FUEL SUPPLY SYSTEM FOR VEHICLE

(75) Inventors: Masato Kumagai, Saitama (JP); Toru Mashimo, Gunma (JP); Satoru Watanabe, Gunma (JP)

(73) Assignee: Hitachi Unisia Automotive, Ltd., Kanagawa (JP)

( * ) Notice: Subject to any disclaimer, the term of this patent is extended or adjusted under 35 U.S.C. 154(b) by 0 days.

(21) Appl. No.: 10/658,193

(22) Filed: Sep. 10, 2003

(65) Prior Publication Data

US 2004/0123843 A1 Jul. 1, 2004

(30) Foreign Application Priority Data

Dec. 27, 2002 (JP) ..... 2002-381139

(51) Int. Cl.[7] ..... F02M 37/04

(52) U.S. Cl. ..... 123/509; 123/494; 123/514; 73/317; 137/558

(58) Field of Search ..... 123/494, 514, 123/509, 516; 137/558, 565, 592, 590; 73/317, 305, 304, 307, 306, 314, 303, 313, 302

(56) References Cited

U.S. PATENT DOCUMENTS 3,678,750 A * 7/1972 DiNoia et al. ..... 73/313
4,706,707 A * 11/1987 Betterton et al. ..... 137/565.24
5,167,156 A * 12/1992 Tozawa ..... 73/317
5,201,298 A * 4/1993 Shearn ..... 123/514
6,002,328 A * 12/1999 Wallrafen ..... 340/450.2
6,192,869 B1 * 2/2001 Hahner et al. ..... 123/509
6,230,690 B1 * 5/2001 Umetsu ..... 123/509
6,401,533 B1 * 6/2002 Gier et al. ..... 73/313
6,681,628 B2 * 1/2004 Sawert et al. ..... 73/317
2001/0025668 A1 10/2001 Enge
2001/0032507 A1 10/2001 Eck

FOREIGN PATENT DOCUMENTS

JP 10-47185 A 2/1998

* cited by examiner

*Primary Examiner*—Carl S. Miller
(74) *Attorney, Agent, or Firm*—Sughrue Mion, PLLC

(57) ABSTRACT

A fuel supply system for a vehicle, the fuel supply system being comprised of a fuel tank, a fuel pump installed in the fuel tank, a fuel level detection unit which is comprised of a float and a sensor member which detects a vertical displacement of the float, and a pressing member which presses with elasticity the sensor member against the inside bottom of the fuel tank.

15 Claims, 3 Drawing Sheets

FUEL SUPPLY SYSTEM FOR VEHICLE

BACKGROUND OF THE INVENTION

The present invention relates to a fuel supply system for a vehicle, in particular, it relates to a fuel supply system for a vehicle which can be favorably employed to supply fuel inside a fuel tank to a vehicle engine.

Generally, a fuel supply system which supplies fuel to an engine or similar device comprises a pump unit which delivers fuel to the engine, and a fuel level detection device which detects a level of fuel remaining in a fuel tank, both the pump unit and the fuel level detection device being disposed inside the fuel tank. The pump unit comprises a fuel pump installed on an upper surface of the fuel tank to suck fuel and deliver the fuel, and a chamber which is cylindrical and closed at the bottom to maintain an amount of fuel around an intake opening of the fuel pump.

The fuel level detection device is mostly comprised of a float which floats on the surface of fuel stored inside the fuel tank, and thus has an upward or downward displacement corresponding to a rise or fall of the surface of the fuel, and a sensor member which is installed on the pump unit to detect a vertical position or height of the surface of the fuel, i.e., a level of the fuel, by detecting a vertical position or height of the float.

Japanese Patent Provisional Application (Helsei) 10-47185 discloses a fuel supply system for supplying fuel that has been sucked by the fuel pump to fuel injectors of an engine by driving the fuel pump of the pump unit.

The float, which floats on the surface of the fuel held in the fuel tank, has a vertical displacement according to a change in height of the surface of the fuel, and the amount of fuel remaining in the fuel tank is detected by detecting the position of the float with the sensor member of the fuel level detection device.

SUMMARY OF THE INVENTION

However, in a fuel supply system according to the above related art, the sensor member of the fuel level detection device is installed on the pump unit, and the pump unit is installed on the upper surface of the fuel tank.

Depending on manufacturing tolerances during assembly, the distance or height from the inside bottom to the inside top of the fuel tank differs slightly with individual fuel tanks. Also, a fuel tank expands or contracts depending on internal pressure of the fuel tank, and the vertical distance from the inside bottom to the inside top of the fuel tank changes.

There is a recent trend to form fuel tanks using a flexible, light-weight material such as synthetic resin in striving for lightness of the entire vehicle, and a fuel tank designed using flexible material deforms depending on a range of factors including change in volume and therefore weight of fuel being held in the tank, change in pressure within the fuel tank, change in temperature around the exterior of the fuel tank, or vibration or shock while the vehicle is traveling.

When a fuel tank deforms in such a way, the surface of the fuel inside the fuel tank rises or falls correspondingly with no change in the actual amount of fuel remaining. Thus, a fuel level detection device according to the related art, which is installed on an upper surface of a fuel tank to detect the amount of fuel remaining by detecting the height or level of the surface of the fuel under such conditions, gives a detection result that is not an accurate indication of the amount of fuel remaining. The problem that arises, then, is how to stabilize a remaining amount of fuel relative to a fuel level detection device to obtain an accurate detection result.

It is therefore an object of the present invention to provide a fuel supply system which is capable of stabilizing fuel inside a fuel tank relative to a fuel level detection device so that the level of remaining fuel can be more accurately determined.

An aspect of the present invention resides in a fuel supply system for a vehicle, the fuel supply system comprising a fuel tank, a pump unit which is installed on a top of the fuel tank, the pump unit sucking fuel from the fuel tank and delivering the fuel to an engine, a fuel level detection device disposed in the fuel tank, the fuel level detection device comprising a float which floats on the fuel in the fuel tank, and a sensor member which is disposed between an inside bottom of the fuel tank and the pump unit, the sensor member detecting a displacement of the float, and a pressing member which is disposed between the pump unit and the sensor member, the pressing member tending to expand and press against the sensor member, the sensor member being pressed against the inside bottom of the fuel tank.

Another aspect of the present invention resides in a fuel supply system for a vehicle which comprises an engine, the fuel supply system comprising a fuel tank, pump means for sucking fuel from the fuel tank and delivering the fuel to the engine, the pump means comprising containing means for maintaining an amount of fuel inside the pump means, the containing means being disposed inside the fuel tank, a float which floats on the surface of fuel in the fuel tank, the float having an upward or downward displacement which corresponds to a respective rise or fall in the surface of the fuel, sensor means for detecting the displacement of the float, the sensor means being disposed on a bottom of the fuel tank, and pressing means for pressing the sensor member against the bottom of the fuel tank with elasticity, the pressing means extending from the containing means.

A further aspect of the present invention resides in a fuel supply system for a vehicle comprising an engine and a fuel tank, the fuel supply system comprising a pump unit which is disposed on a top of the fuel tank, the pump unit comprising a chamber suspended inside the fuel tank, a sensor member which is disposed on an inside bottom of the fuel tank, a float which has a displacement corresponding to a change in a level of the surface of the fuel, the displacement being detected by the sensor member, and elastic pressing means for pressing against the sensor member with elasticity, the elastic pressing means being disposed between a top of the sensor member and the chamber.

DETAILED DESCRIPTION OF THE INVENTION

Figure 1:
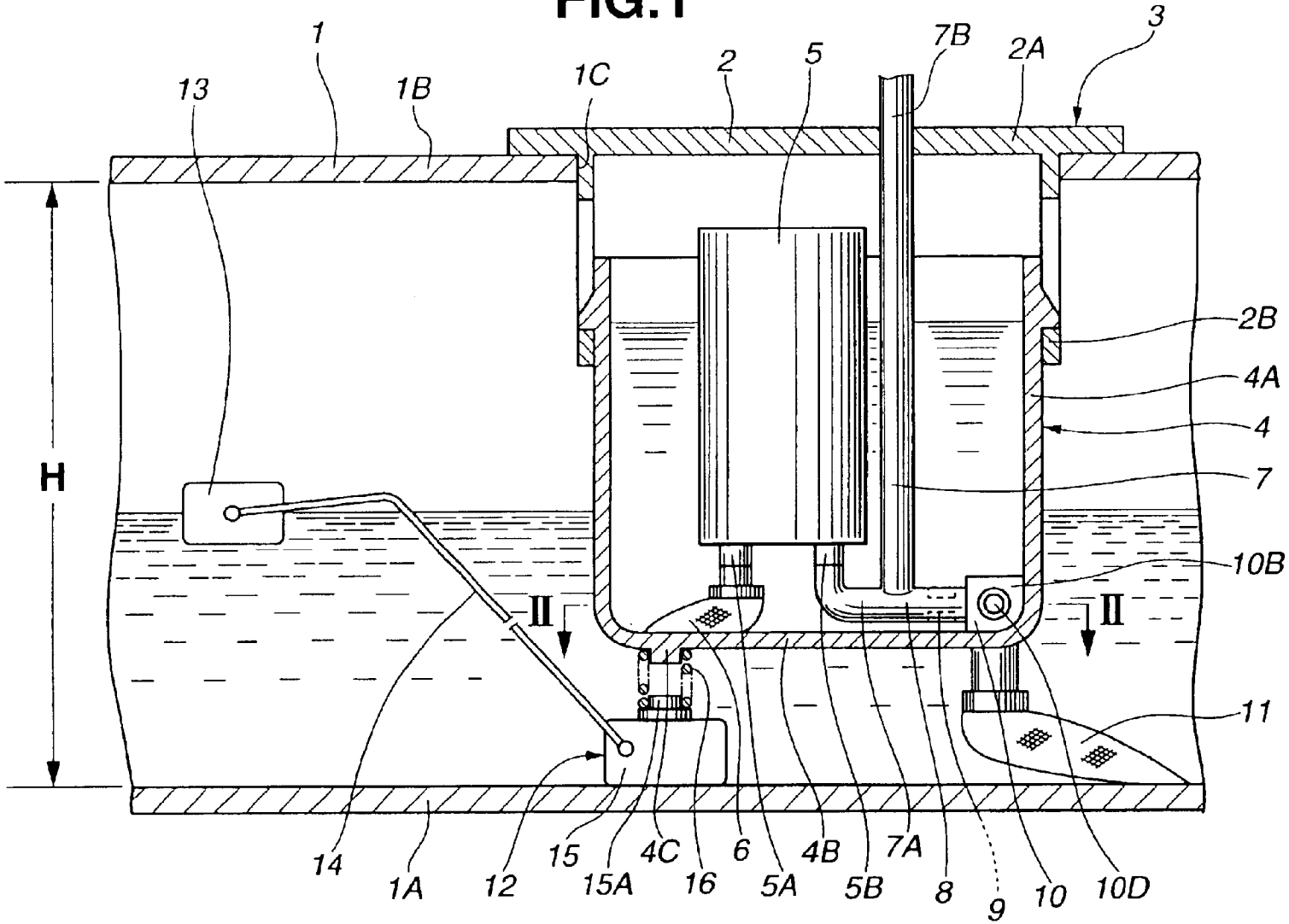
FIG. 1 is a cross-sectional view of a first embodiment of a fuel supply system according to the present invention.
Figure 2:
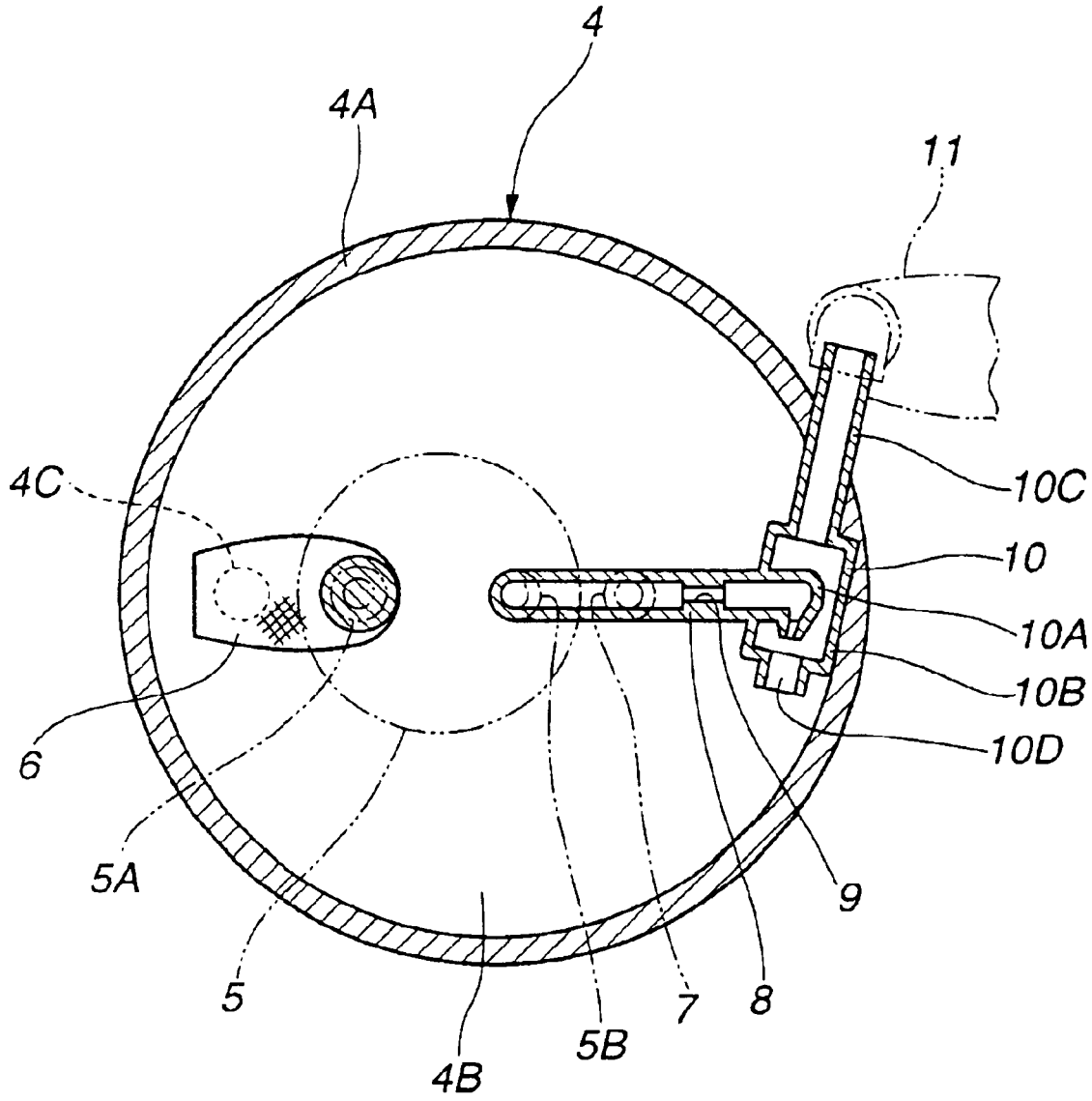
FIG. 2 is an enlarged cross-sectional view of a chamber, suction pump, and other components of the fuel supply system shown in FIG. 1 taken along the line II—II.

Referring to FIGS. 1 and 2, there is discussed a first embodiment of a fuel supply system in accordance with the present invention.

A fuel tank 1 for holding fuel is mounted in a vehicle as shown in FIG. 1, fuel tank 1 being designed substantially in a box shape and is made from a material such as metal or resin. Fuel tank 1 comprises a bottom portion 1A and a top portion 1B, top portion 1B defining an installation opening 1C on which a cover 2 is installed.

Cover 2 acts to cover and close installation opening 1C. Cover 2 comprises a flat portion 2A which rests on the top of top portion 1B to form a substantially continuing surface with top portion 1B, and a chamber installation portion 2B which is cylindrical and formed on an underside of flat portion 2A so as to project through installation opening 1C and into fuel tank 1.

A pump unit 3 acts as a pump installed on top portion 1B of fuel tank 1 by means of cover 2. Pump unit 3 serves to suck fuel from inside fuel tank 1 and deliver the sucked fuel to an engine (not shown). Pump unit 3 is largely comprised of a chamber 4, a fuel pump 5, and a suction pump 10.

Chamber 4 is disposed inside fuel tank 1 in a suspended fashion from top portion 1B. As shown in FIGS. 1 and 2, chamber 4 is formed as a cylinder with a closed bottom, comprising a cylinder portion 4A which is installed on chamber installation portion 2*b* of cover 2 and acts as an enclosing side wall of chamber 4, and a base portion 4B which closes the bottom of cylinder portion 4A and acts as a bottom of chamber 4. Chamber 4 serves as a constant reservoir for a portion of the fuel inside fuel tank 1 so that an amount of fuel is maintained inside pump unit 3 around an intake opening 5A of fuel pump 5. On the outside bottom of base portion 4B, which comes within proximity of bottom portion 1A of fuel tank 1, a spring attachment projection 4C is disposed to project toward bottom portion 1A of fuel tank 1. A coiled spring 16 is attached to spring attachment projection 4C.

Fuel pump 5 is disposed with a vertical orientation within chamber 4 such that one end faces flat portion 2A of cover 2 and another end faces base portion 4B. Fuel pump 5 sucks fuel from inside chamber 4 and delivers the fuel to the fuel injectors (not shown) of an engine. Fuel pump 5 includes a motor member (not shown) which has a rotor which rotates relative to a stator when electrically energized by an external source, a pump member (not shown) which is rotatingly driven by the motor member to perform sucking and delivering of fuel, intake opening 5A through which fuel inside chamber 4 is sucked, and a delivery opening 5B through which the sucked fuel is delivered to a supply pipe 7, described hereinafter. An internal intake filter 6 is attached to intake opening 5A to prevent foreign particles from entering fuel pump 5 as fuel is sucked from inside chamber 4, through intake opening 5A, and into fuel pump 5.

Supply pipe 7 carries fuel from inside tank 1 to outside tank 1. An inflow end of supply pipe 7 is connected to delivery opening 5B of fuel pump 5. Supply pipe 7 comprises a connecting branch 7A which extends laterally, and a delivery branch 7B which extends upward from an outflow end of connecting branch 7A. The outflow end of delivery branch 7B projects through flat portion 2A of cover 2 to outside of fuel tank 1, and is connected to fuel injectors via a fuel conduit.

An inflow end of a suction pump pipe 8 is connected to connecting branch 7A of supply pipe 7, and an outflow end of suction pump pipe 8 is connected to suction pump 10. A suction pump pipe 8 supplies a portion of fuel which is being delivered by fuel pump 5 to suction pump 10, described later. A narrow portion 9 is disposed within suction pump pipe 8 at a position approximately halfway thereof to separate fuel being delivered by fuel pump 5 into a portion which flows to suction pump 10 and a portion which flows to an engine.

Suction pump 10 is disposed on an inside bottom of chamber 4, and comprises, for example, a jet pump, which utilizes a portion of fuel being delivered from fuel pump 5 to cause fuel outside chamber 4 to flow into chamber 4.

As shown in FIGS. 1 and 2, suction pump 10 comprises a nozzle portion 10A connected to an outflow end of suction pump pipe 8, a pump case 10B formed as a cylinder to enclose nozzle portion 10A, an intake pipe 10C which extends from pump case 10B and projects outside of chamber 4, and an ejection opening 10D disposed on pump case 10B to eject fuel flowing out from nozzle portion 10A together with fuel sucked from intake pipe 10C together. An external intake filter 11 is attached to an end of intake pipe 10C projecting outside of chamber 4 to prevent foreign particles from entering suction pump 10.

A fuel level detection device 12 is disposed inside fuel tank 1 as a fuel level detection means to detect a level of fuel remaining inside fuel tank 1. Fuel level detection device 12 comprises a float 13, an arm 14 connected to float 13, and a sensor member 15 to which arm 14 is swingably connected. Float 13 is buoyant and floats on the surface of fuel inside tank 1, and is vertically displaced depending on the level of the surface of the fuel, that is, float 13 moves upward or downward with a respective rise or fall in the surface of fuel in fuel tank 1. Sensor member 1s is disposed on an inside bottom of fuel tank 1 near a lower end of chamber 4 such that sensor member 15 is disposed under chamber 4.

Since one end of arm 14 is connected to float 13 which moves upward and downward relative the inside bottom of fuel tank 1, and the other end of arm 14 is connected to sensor member 15 which does not move relative to the inside bottom of fuel tank 1, an angle of arm 14 depends on the displacement or vertical position of float 13. Sensor 15 contains an internal potentiometer or similar device, and detects the angle of arm 14 based on a detected change in electrical resistance. Sensor member 15 is pressed against bottom portion 1A of fuel tank 1 by coiled spring 16, described later. Further, a spring attachment projection 15A is disposed on a top surface of sensor member 15 so as to project upward in opposition to spring attachment projection 4C of chamber 4.

By sensor member 15 being disposed on bottom portion 1A of fuel tank 1, displacement of float 13 is easily ascertained by detecting an angle of arm 14 using bottom portion 1A as a reference point. This enables an accurate detection of the amount of remaining fuel in tank 1 by fuel level detection device 12. This will be explained in more detail later.

Coiled spring 16 extends from chamber 4 as a pressing means between chamber 4 of pump unit 3 and sensor member 15 of fuel level detection device 12 such that sensor member 15 is disposed between coiled spring 16 and bottom portion 1A of fuel tank 1. Coiled spring 16 tends to expand and push against sensor member 15, therefore, sensor member 15 is pressed against bottom portion 1A of fuel tank 1 with elasticity. That is, coiled spring 16 presses sensor member 15 against bottom portion 1A of fuel tank 1 by the spring force of coiled spring 16. One end of coiled spring 16 is fitted around spring attachment projection 4C disposed on base portion 4B of chamber 4, and another end is fitted around spring attachment projection 15A disposed on a top surface of sensor member 15.

The level of the surface of fuel inside fuel tank 1 can change although the amount of fuel actually present does not change. This is due to the physical dimensions of fuel tank 1 changing, and is attributable to various influences. As an example, a vertical distance H from bottom portion 1A to top portion 1B inside fuel tank 1 may differ depending on manufacturing tolerances during assembly. Vertical distance H may also vary when fuel tank 1 expands or contracts as a result of changes in internal pressure.

Fuel tank 1, being made of a resin material, may also deform due to a change in amount and therefore weight of fuel being held, a change in internal pressure of fuel tank 1, a change in temperature outside fuel tank 1, or due to vibration or shock which may occur while the vehicle is traveling. Under such conditions, float 13 rises or falls together with the surface of fuel in fuel tank 1, therefore having a vertical displacement.

To counter these effects, coiled spring 16 is formed to be expandable in such instances to a necessary length, and is therefore able to constantly press sensor member 15 to bottom portion 1A of fuel tank 1, including instances where fuel tank 1 deforms and vertical distance H reaches a maximum value.

Operation of the fuel supply system will now be explained. First, by driving fuel pump 5, fuel pump 5 sucks fuel from inside chamber 4 through intake opening 5A, and delivers the fuel through delivery opening 5B to connecting branch 7A of supply pipe 7. Next, fuel flows both into suction pump pipe 8 and into delivery branch 7B of supply pipe 7. The portion of fuel flowing into delivery branch 7B is delivered to fuel injectors via a fuel conduit, and eventually injected from the fuel injectors into the cylinders of an engine.

The portion of fuel flowing into suction pump pipe 8 passes through narrow portion 9 and flows into suction pump 10 to drive suction pump 10. Thus, fuel inside fuel tank 1 is drawn by suction pump 10 into chamber 4.

Detection of a remaining amount of fuel being held in fuel tank 1 using fuel level detection device 12 will be explained.

The surface of fuel held in fuel tank 1 rises or falls and is therefore vertically displaced when, for example, fuel is supplied to or consumed from fuel tank 1. As a result, float 13, which floats on the surface of the fuel, also rises or falls with the rise or fall of the surface of the fuel, and an angle of arm 14 with respect to sensor member 15 changes accompanying upward or downward movement of float 13. In this way, sensor member 15 is able to detect a height or vertical position of float 13 and determine the amount of fuel remaining based on the angle of arm 14.

According to the first embodiment of the present invention, coiled spring 16 is disposed between chamber 4 of pump unit 3 and sensor member 15 of fuel level detection device 12, so that sensor member 15 is pressed with elasticity against bottom portion 1A of fuel tank 1 by coiled spring 16. Thus, sensor member 15 of fuel level detection device 12 is constantly maintained on bottom portion 1A of fuel tank 1. It is then possible for sensor member 15 to use bottom portion 1A as a reference point when detecting vertical displacement of float 13.

As a result, even in an instance where fuel tank 1 deforms and vertical distance H inside fuel tank 1 changes, fuel level detection device 12 rises or falls similar to the surface of fuel inside fuel tank 1. Fuel level detection device 12 is therefore able to detect a remaining amount of fuel with disregard for vertical distance H.

Moreover, sensor member 15 can be simply emplaced using base portion 4B of chamber 4, and also, when installing pump unit 3 in fuel tank 1, fuel level detection device 12 can also be installed at the same time, so the amount of assembly time required can also be reduced.

Further, when changing the layout inside fuel tank 1, that is, the installation position of fuel level detection device 12, and even when installing in another fuel tank of differing shape, any change in vertical distance H can be compensated for owing to the elastic property of coiled spring 16, so fuel level detection device 12 can be simply adapted to the fuel tank.

Figure 3:
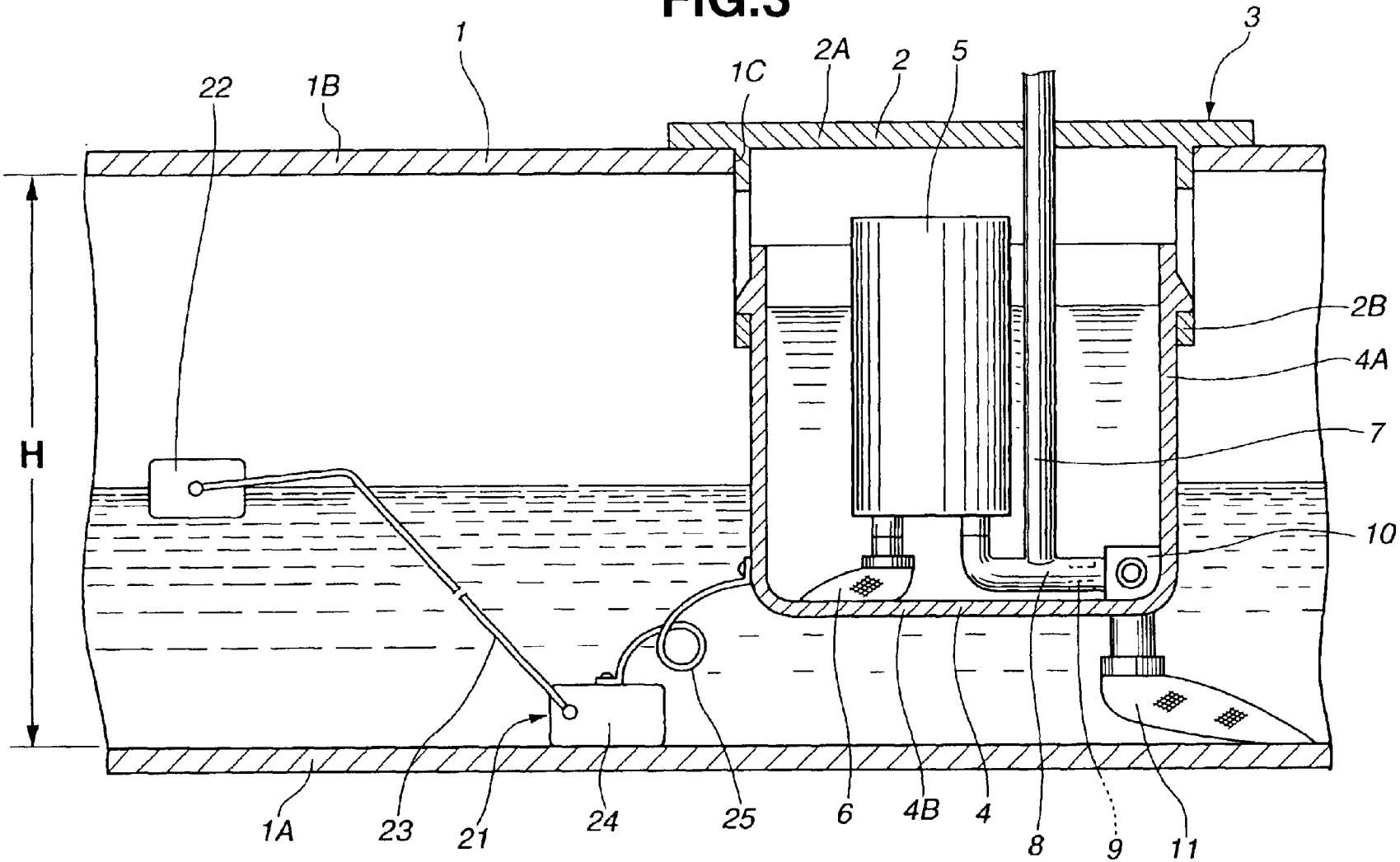
FIG. 3 is a cross-sectional view of a second embodiment of the fuel supply system according to the present invention.

A second embodiment of the present invention will now be explained referring to FIG. 3. A feature of the second embodiment lies in a sensor member of a fuel level detection means being disposed to the side of a chamber inside a fuel tank, the sensor member being pressed against an inside bottom of the fuel tank by a helical torsion spring. Elements which are common to both the second embodiment and the first embodiment make use of the same reference numerals, and explanation thereof is abbreviated.

A fuel level detection device 21 comprises a float 22, an arm 23, and a sensor member 24. Fuel level detection device 21 functions as a fuel level detection means in the second embodiment to detect a level of remaining fuel being held in fuel tank 1 in a substantially similar manner as fuel level detection device 12 of the first embodiment. However, fuel level detection device 21 according to the second embodiment differs from fuel level detection device 12 of the first embodiment in that sensor member 24 is disposed to the side of chamber 4 between bottom portion 1A of fuel tank 1 and pump unit 3. That is, sensor member 24 is disposed outside an area which is directly under chamber 4.

A helical torsion spring 25 extends from chamber 4 as a pressing means disposed between chamber 4 and sensor member 24 of fuel level detection device 21. Helical torsion spring 25 tends to expand and push against sensor member 24, therefore, sensor member 24 is pressed against bottom portion 1A of fuel tank 1 with elasticity. That is, sensor member 24 is pressed against bottom portion 1A of fuel tank 1 by spring force of helical torsion spring 25. One end of helical torsion spring 25 is attached to cylinder portion 4A of chamber 4 such that helical torsion spring 25 is attached to a side of chamber 4, and another end thereof is attached to a top surface of sensor member 24. Helical torsion spring 25 is capable of constantly pressing sensor member 24 against bottom portion 1A, even in an instance where fuel tank 1 deforms and vertical distance H increases to a maximum value.

Also, with the second embodiment composed in this manner, it is possible to gain effects similar to those of the first embodiment. Particularly, the second embodiment is more widely adaptable to changes in layout or to other fuel tanks, since sensor member 24 of fuel level detection device 21 is disposed to the side of chamber 4, so that an amount of space available for sensor member 24 directly underneath chamber 4 does not have to be taken into account.

This application is based on a prior Japanese Patent Application No. 2002-381139 filed on Dec. 27, 2002. The entire contents of these Japanese Patent Applications No. 2002-381139 are hereby incorporated by reference.

Although the invention has been described above by reference to certain embodiments of the invention, the invention is not limited to the embodiments described above. Modifications and variations of the embodiments described above will occur to those skilled in the art in light of the above teachings. For example, other pressing means, such as a rubber spring or a leaf spring may be employed. Also, for example, fuel pump 5 may be installed on a vertically descending bracket which may be attached to cover 2 with pressing means being disposed between fuel pump 5 and sensor member 15 of fuel level detection device 12. The scope of the invention is defined with reference to the following claims.

What is claimed is:

1. A fuel supply system for a vehicle, the fuel supply system comprising:

a fuel tank;

a pump unit which is installed on a top of the fuel tank, the pump unit sucking fuel from the fuel tank and delivering the fuel to an engine;

a fuel level detection device disposed in the fuel tank, the fuel level detection device comprising a float which floats on the fuel in the fuel tank, and a sensor member which is disposed between an inside bottom of the fuel tank and the pump unit, the sensor member detecting a displacement of the float; and a pressing member which is disposed between the pump unit and the sensor member, the pressing member pressing against the sensor member, the sensor member being pressed against the inside bottom of the fuel tank.

2. The fuel supply system as claimed in claim 1, wherein the pump unit comprises a fuel pump which sucks fuel from the fuel tank and delivers the sucked fuel, and a chamber which is disposed inside the fuel tank, the chamber being cylindrical and having a closed bottom to maintain fuel around an intake opening of the fuel pump.

3. The fuel supply system as claimed in claim 1, wherein the pressing member is connected to the sensor member and a bottom of the chamber.

4. The fuel supply system as claimed in claim 3, wherein the sensor member is disposed under the chamber.

5. The fuel supply system as claimed in claim 4, wherein the pressing member comprises a coiled spring, one end of the coiled spring being connected to a bottom of the chamber and another end thereof being connected to the sensor member.

6. The fuel supply system as claimed in claim 5, wherein the chamber comprises a first attachment projection on the bottom thereof, one end of the coiled spring being connected to the first attachment projection.

7. The fuel supply system as claimed in claim 6, wherein the sensor member comprises a second attachment projection on a top thereof, the other end of the coiled spring being connected to the second attachment projection.

8. The fuel supply system as claimed in claim 1, wherein the pressing member is connected to the sensor member and a side of the chamber.

9. The fuel supply system as claimed in claim 8, wherein the sensor member is disposed outside an area which is directly under the chamber.

10. The fuel supply system as claimed in claim 8, wherein the pressing member comprises a helical torsion spring, one end of the helical torsion spring being connected to a side of the chamber and another end thereof being connected to the sensor member.

11. The fuel supply system as claimed in claim 1, wherein the pressing member comprises a spring, one end of the spring being connected to the chamber and another end of the spring being connected to the sensor member.

12. The fuel supply system as claimed in claim 1, wherein the pressing member is disposed between the chamber and the sensor member.

13. The fuel supply system as claimed in claim 1, wherein the sensor member comprises an arm, one end of the arm being swingably connected to the sensor member and the other end of the arm being connected to the float.

14. A fuel supply system for a vehicle which comprises an engine, the fuel supply system comprising:

a fuel tank;

pump means for sucking fuel from the fuel tank and delivering the fuel to the engine, the pump means comprising containing means for maintaining an amount of fuel inside the pump means, the containing means being disposed inside the fuel tank;

a float which floats on the surface of fuel in the fuel tank, the float having an upward or downward displacement which corresponds to a respective rise or fall in the surface of the fuel;

sensor means for detecting the displacement of the float, the sensor means being disposed on a bottom of the fuel tank; and pressing means for pressing the sensor member against the bottom of the fuel tank with elasticity, the pressing means extending from the containing means.

15. A fuel supply system for a vehicle comprising an engine and a fuel tank, the fuel supply system comprising:

a pump unit which is disposed on a top of the fuel tank, the pump unit comprising a chamber suspended inside the fuel tank;

a sensor member which is disposed on an inside bottom of the fuel tank;

a float which has a displacement corresponding to a change in a level of the surface of the fuel, the displacement being detected by the sensor member; and elastic pressing means for pressing against the sensor member with elasticity, the elastic pressing means being disposed between a top of the sensor member and the chamber.

* * * * *